US006655525B2

(12) United States Patent
Song

(10) Patent No.: US 6,655,525 B2
(45) Date of Patent: Dec. 2, 2003

(54) CONTAINER CAPABLE OF SEPARATELY STORING AND MIXING TWO SUBSTANCES TOGETHER

(75) Inventor: Gam-Seob Song, Kyunggi-do (KR)

(73) Assignee: Joycos, Ltd. (KR)

( * ) Notice: Subject to any disclaimer, the term of this patent is extended or adjusted under 35 U.S.C. 154(b) by 36 days.

(21) Appl. No.: 10/127,387

(22) Filed: Apr. 22, 2002

(65) Prior Publication Data

US 2003/0052019 A1 Mar. 20, 2003

(30) Foreign Application Priority Data

Sep. 19, 2001 (KR) ..... 2001-28896

(51) Int. Cl.[7] ..... B65D 25/08
(52) U.S. Cl. ..... 206/222; 206/219; 215/DIG. 8
(58) Field of Search ..... 206/219–222, 206/568; 215/DIG. 8; 222/83, 83.5, 88

(56) References Cited

U.S. PATENT DOCUMENTS

| | | | | |
|---|---|---|---|---|
| 3,802,604 A | | 4/1974 | Morane et al. | |
| 4,727,985 A | | 3/1988 | McNeirney et al. | |
| 5,277,303 A | * | 1/1994 | Goyet et al. | 206/221 |
| 5,447,226 A | | 9/1995 | Laine | |
| 5,692,644 A | | 12/1997 | Gueret | |
| 6,022,134 A | | 2/2000 | Andrews | |
| 6,189,688 B1 | | 2/2001 | Aneas | |
| 6,209,757 B1 | | 4/2001 | Dumont | |
| 6,257,428 B1 | | 7/2001 | Caola | |
| 6,293,395 B1 | * | 9/2001 | Hof | 206/219 |
| 6,305,576 B1 | | 10/2001 | Leoncavallo | |
| 6,321,908 B1 | * | 11/2001 | Lorscheidt | 206/221 |
| 6,474,861 B1 | * | 11/2002 | De Laforcade | 206/219 |
| 6,481,571 B1 | * | 11/2002 | Kelders et al. | 206/219 |

FOREIGN PATENT DOCUMENTS

| | | |
|---|---|---|
| GB | 1107873 | 3/1968 |
| JP | 09/253354 | 6/1999 |
| WO | WO/0024649 | 5/2000 |

* cited by examiner

*Primary Examiner*—Luan K. Bui
(74) *Attorney, Agent, or Firm*—Piper Rudnick LLP

(57) ABSTRACT

Disclosed herein is a container capable of separately storing two substances as well as mixing them together. The container includes a liquid storing chamber, a powder storing cup, a cover unit, and a rotary cap. The liquid storing chamber is provided with an outlet port and a lower opening. A locking ring is formed around the outer surface of a sidewall defining the opening. The powder storing cup is provided at a lower position on its outer surface with at least one projection. The cover unit consists of a cover plate provided on its top portion, an annular sidewall fitted into the lower opening of the storing chamber, and a leg downwardly extending from the lower end of the annular sidewall and provided with a slit engaging with the projection of the storing cup. The rotary cap consists of an annular groove formed at an upper position on its inner surface and engaging with the locking ring of the storing chamber, and a spiral groove formed at a lower position on its inner surface and engaging with the projection of the storing cup.

2 Claims, 4 Drawing Sheets

CONTAINER CAPABLE OF SEPARATELY STORING AND MIXING TWO SUBSTANCES TOGETHER

BACKGROUND OF THE INVENTION

1. Field of the Invention

The present invention relates generally to a container capable of mixing two substances together, and more particularly to a container which is capable of separately storing two substances, for example powder and liquid, or liquid and liquid, in two reservoirs provided in the container, and of mixing the substances together when necessary. This invention provides a container, which is easy to manufacture and effective in terms of economy, and which enables easy mixing of substances, thus accomplishing an excellent mixing result. The container of this invention can be widely used in homes, laboratories and drugstores, and for individual use and other industrial uses.

2. Description of the Prior Art

When powder and liquid are mixed together and held in one container for a lengthy period of time, there frequently occur cases where the properties of the mixture are changed. Thus, there is a demand for a container which is capable of separately storing substances as well as mixing them together when necessary.

In order to achieve the above object, there have been proposed various containers, each of which is provided with two reservoirs. However, conventional containers each have a problem that it is relatively high in its manufacturing cost, inconvenient to mix substances, and difficult to achieve an excellent mixing result.

For example, U.S. Pat. No. 3,802,604 discloses a device for storing and dispensing substances. This device consists of a liquid holding container, a powder holding cup, a cap, a cover, and a tear-strip. In this case, the powder holding cup has a cylindrical shape, and is positioned inside a neck of the container. The cap is fitted over the neck. The cover is also fitted over the cap in such a way as to move up and down, and has a trocar which is integrally formed in the cover. Further, the tear-strip is attached to the sidewall of the container in order to prevent unexpected downward movement of the cover. When it is required to mix liquid with powder, the tear-strip is primarily removed from the container. Then, when strongly pressing down on the cover, the trocar passes from the cover to the bottom of the cup such that the powder is dropped into the liquid. The conventional device for storing and dispensing substances has an advantage that two substances are thoroughly separated from each other when storing the substances. But, the conventional device for storing and dispensing substances has a problem that it is high in its manufacturing cost, because the device has a considerably complicated structure. The conventional device for storing and dispensing substances has another problem that it is difficult to mix substances together and part of the device may be broken, because it needs a strong vertical pressing force for mixing substances together. In addition, the conventional device for storing and dispensing substances has a further problem that it is difficult to achieve an excellent mixing result, because the whole quantity of powder is simultaneously dropped to the surface of liquid, thus forming a plurality of powder lumps.

U.S. Pat. No. 5,692,644 discloses another container. This container consists of a first product reservoir, a cylindrical second product reservoir, a movable wall, a movable bottom, and an actuating means. The first product reservoir holds liquid. The second product reservoir holds powder and has a mouth fixed to the first product reservoir. The movable wall is positioned in the mouth to separate the first and second reservoirs. The movable bottom of the second reservoir has an outer diameter which is substantially equal to the inner diameter of the mouth. The actuating means engages with the external surface of the second reservoir in such a way as to vertically move, and is integrated with a piston for displacing the movable bottom. When it is required to mix liquid with powder in the container, the actuating means is strongly pressed upwardly. At this time, the piston moves upward while passing through the second reservoir to push the powder up. Subsequently, the piston passes through the movable wall such that the powder is dispersed in the liquid. This container has a more excellent mixing result in comparison with the device for storing and dispensing substances according to U.S. Pat. No. 3,802,604. However, as the piston moves up, the volume of the second reservoir is gradually reduced, and simultaneously the powder is subject to an excessive strong pressure, so stress among powder particles is increased. This prevents the powder from being freely dispersed in the liquid. That is, when two substances are mixed together, several powder lumps are generated, so it takes a long time to completely mix two substances. This container has a problem that its manufacturing cost is high, because its construction is complicated. Further, this container is equal to the device for storing and dispensing substances of U.S. Pat. No. 3,802,604 in that it needs a strong vertical pressing force for mixing substances together.

SUMMARY OF THE INVENTION

Accordingly, the present invention has been made keeping in mind the above problems occurring in the prior art, and an object of the present invention is to provide a container, which is capable of separately storing two substances in two reservoirs provided in the container and mixing them together. This container consists of a liquid storing chamber, a powder storing cup positioned below the liquid storing chamber, a cover unit and a rotary cap. In this case, the cover unit is closely fitted into the liquid storing chamber, and has a cover plate on its top portion. The rotary cap is actuated to vertically move the powder storing cup. In this container, the powder storing cup itself moves up by the rotation of the rotary cap. At this time, the cover plate is removed from the cover unit, so the powder storing cup is positioned inside the liquid storing chamber. Therefore, the present invention provides a container, which is easily operated to achieve a more excellent mixing result, in comparison with the conventional pushing-type container designed to press up powder.

In order to accomplish the above object, the present invention provides a container capable of separately storing two substances as well as mixing them together, comprising: a cylindrical liquid storing chamber provided at its upper end with an outlet port and also provided at its lower end with a lower opening, with a locking ring formed around an outer surface of a sidewall defining the opening; a movable powder storing cup provided at a lower position on its outer surface with at least one projection; a cover unit consisting of a cover plate provided on its top portion and separating the storing chamber from the storing cup, an annular sidewall having an outer diameter equal to an inner diameter of the liquid storing chamber to be fitted into the lower opening of the storing chamber, and a leg downwardly extending from the lower end of the annular sidewall and provided with a slit engaging with the projection of the storing cup;

and a rotary cap consisting of an annular groove formed at an upper position on the inner surface of the rotary cap and engaging with the locking ring of the storing chamber, and a spiral groove formed at a lower position on the inner surface of the rotary cap and engaging with the projection of the storing cup, the projection inserted into the slit of the cover unit.

In the container according to this invention, the powder storing cup is vertically displaced from a first position where the powder storing cup is positioned below the liquid storing chamber to a second position where the powder storing cup is positioned in the liquid storing chamber by removing the cover plate from the cover unit. Such a displacement is performed by the rotation of the rotary cap. When the rotary cap is rotated, the powder storing cup moves up by the projection engaging with the spiral groove of the rotary cap. At this time, since the rotation of the projection is prevented by the slit of the cover unit which is fitted into the liquid storing chamber, the powder storing cup is vertically moved. The cover plate is removed from the cover unit when coming into contact with the upper end of the powder storing cup which is upwardly moved. Thereafter, the powder of the powder storing cup is mixed with the liquid in the liquid storing chamber.

Preferably, a serrated blade is formed along the upper end of the powder storing cup for allowing the cover plate to be smoothly removed from the cover unit. In addition, a support column is positioned in the powder storing cup in such a way as to uprightly stand on the bottom of the powder storing cup 20, thus preventing the cover plate removed from the cover unit from covering the powder storing cup.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
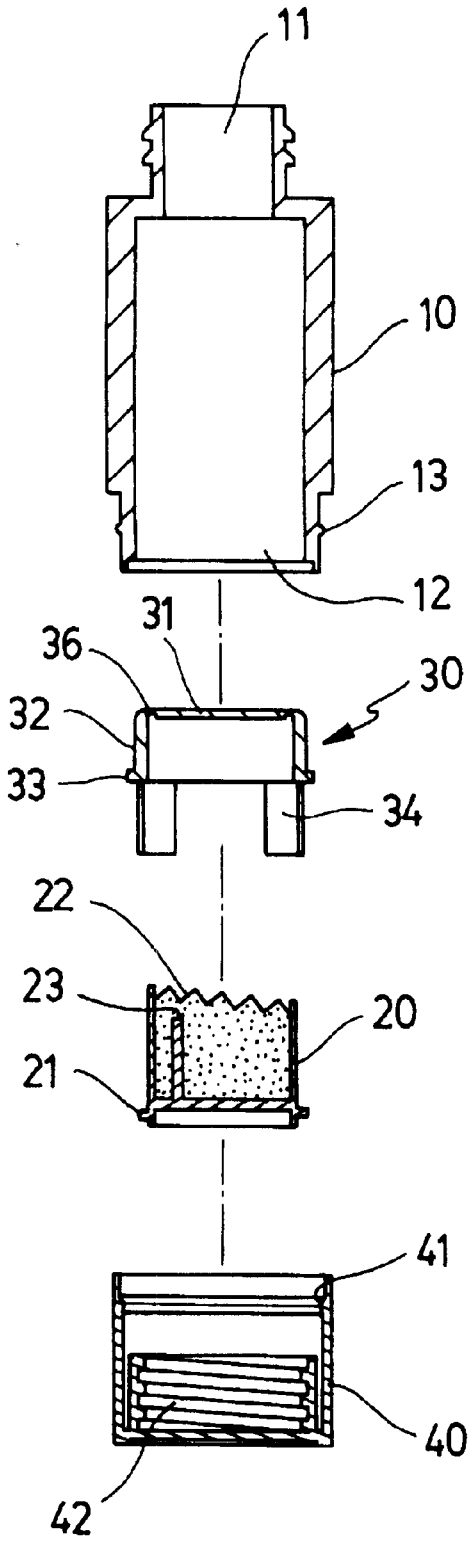
FIG. 1 is an exploded sectional view showing a container according to the preferred embodiment of the present invention.

Reference now should be made to the drawings, in which the same reference numerals are used throughout the different drawings to designate the same or similar components.

FIGS. 1 to 4 show a container according to the preferred embodiment of the present invention.

Figure 2:
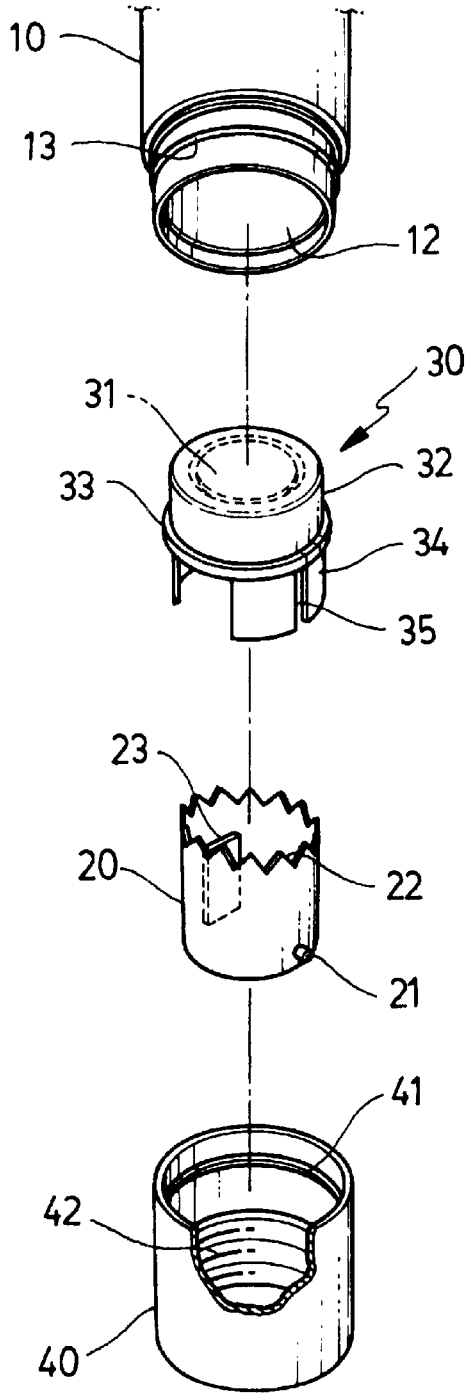
FIG. 2 is an exploded perspective view of the container of the preferred embodiment of this invention.

Referring to FIGS. 1 and 2, the container consists of a liquid storing chamber 10, a powder storing cup 20, a cover unit 30 for covering the powder storing cup 20, and a rotary cap 40 for moving the powder storing cup 20. The liquid storing chamber 10, the powder storing cup 20, the cover unit 30 and the rotary cap 40 are made of injection molded plastics, such as polypropylene and others. The components of the container will be described in the following.

Figure 3:
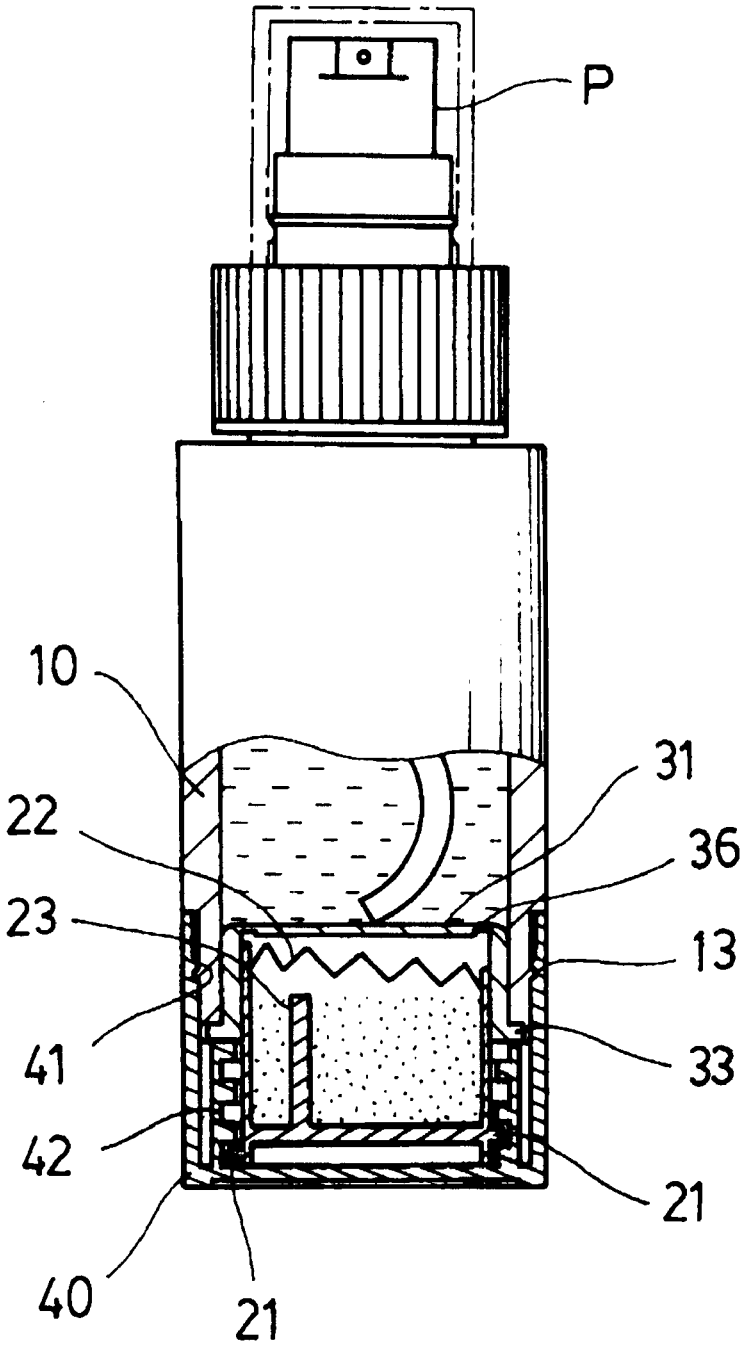
FIG. 3 is a sectional view of the container when assembling the components of the container shown in FIG. 1, in which two substances are separately stored in the container.

The liquid storing chamber 10 has a shape of a cylinder which is opened at its top and bottom, and is provided at its lower end with a lower opening 12. A locking ring 13 is formed around the outer surface of a sidewall defining the lower opening 12. In this case, an upper opening of the liquid storing chamber 10 is an outlet port 11 through which a mixture is discharged. As shown in FIG. 3, a pusher mechanism P may be installed on the outlet port 11 to operate a pump (not shown) used for discharging stored substances.

The powder storing cup 20 has a shape of a usual cup which is opened at its upper end with a bottom wall, and is provided at a lower position on its outer surface with at least one projection 21. In this case, the powder storing cup 20 is designed in such a way that its outer diameter is equal to or slightly smaller than the inner diameter of a sidewall 32 of the cover unit 30. Further, when the powder storing cup 20 is covered with the cover unit 30, the projection 21 of the powder storing cup 20 is projected from a slit 35 of the cover unit 30. The powder storing cup 20 is fitted in the sidewall 32 of the cover unit 30 to be movable within the length range of the slit 35. Preferably, a serrated blade 22 is formed along the upper end of the powder storing cup 20 for allowing the cover plate 31 to be smoothly removed from the cover unit 30. In addition, a support column 23 is provided in the powder storing cup 20 in such a way as to uprightly stand on the bottom of the powder storing cup 20, thus preventing the cover plate 31 removed from the cover unit 30 from covering the powder storing cup 20.

The cover unit 30 consists of the cover plate 31, the sidewall 32, and a leg 34. In this case, the cover plate 31 is removably provided on the top portion of the cover unit 30. The leg 34 downwardly extends from a flange 33 of the sidewall 32 and is provided with the slit 35. The sidewall 32 has an annular shape and is designed in such a way that its outer diameter is equal to the inner diameter of the lower opening 12 of the liquid storing chamber 10. Thus, the cover unit 30 is fitted into the liquid storing chamber 10 by inserting the sidewall 32 of the cover unit 30 into the lower opening 12 of the liquid storing chamber 10. When the cover unit 30 is fitted into the liquid storing chamber 10 in this way, the cover plate 31 is positioned in such a way as to separate the liquid storing chamber 10 and the powder storing cup 20. Preferably, a score 36 is formed along the circumference of the cover plate 31 for allowing the cover plate 31 to be easily removed from the sidewall 32.

The rotary cap 40 is designed to receive the powder storing cup 20 and the cover unit 30 covering the powder storing cup 20 therein. Further, the rotary cap 40 consists of an annular groove 41 and a spiral groove 42. The annular groove 41 is formed at an upper position on the inner surface of the rotary cap 40 to engage with the locking ring 13 of the liquid storing chamber 10, such that the rotary cap 40 is rotatably connected to the lower end of the liquid storing chamber 10. The spiral grove 42 is formed at a lower position on the inner surface of the rotary cap 40 and engages with the projection 21 of the powder storing cup 20. In this case, the projection 21 is inserted into the slit 35 of the cover unit 30.

The process of assembling the above components is as follows. First, the cover unit 30 is connected to the liquid storing chamber 10 by inserting the sidewall 32 of the cover unit 30 into the lower opening 12 of the liquid storing chamber 10. When the cover unit 30 is stopped by the flange 33, the leg 34 of the cover unit 30 is exposed to the outside of the lower opening 12. Next, the upper end of the powder storing cup 20 is fitted into the cover unit 30. When the projection 21 is inserted into the slit 35 formed on the leg 34, it is possible to fit the upper end of the powder storing cup

20 into the cover unit 30. Finally, the rotary cap 40 is pushed up, in the state where the projection projected from the slit 35 engages with the spiral groove 42 formed in the rotary cap 40. At this time, the annular groove 41 engages with the locking ring 13 of the liquid storing chamber 10, so the container is completed as shown in FIG. 3.

The container having a structure of FIG. 3 is operated in the following manner. In order to separately store powder and liquid, the container is in the state shown in FIG. 3, that is, a state where the powder storing cup 20 is positioned below the liquid storing chamber 10. On the contrary, when it is required to mix two substances together, the rotary cap 40 is rotated in a predetermined direction. At this time, a predetermined rotating force is generated. The rotating force allows the powder storing cup 20 to move after the projection 21 of the cup 20 is removed from the spiral groove 42 of the rotary cap 40. The movement of the projection 21 is limited by the slit 35, so the powder storing cup 20 vertically moves. The powder storing cup 20 moves up while its upper end comes into contact with the score 36 of the cover plate 31, so the cover plate 31 is removed from the cover unit 30. The powder storing cup 20 continuously moves upwardly until its projection 21 reaches the upper end of the slit 35. As such, while the powder storing cup 20 moves up, the cup 20 itself is received in the liquid storing chamber 10, so the powder is dispersed in the liquid and then mixed therewith.

Figure 4:
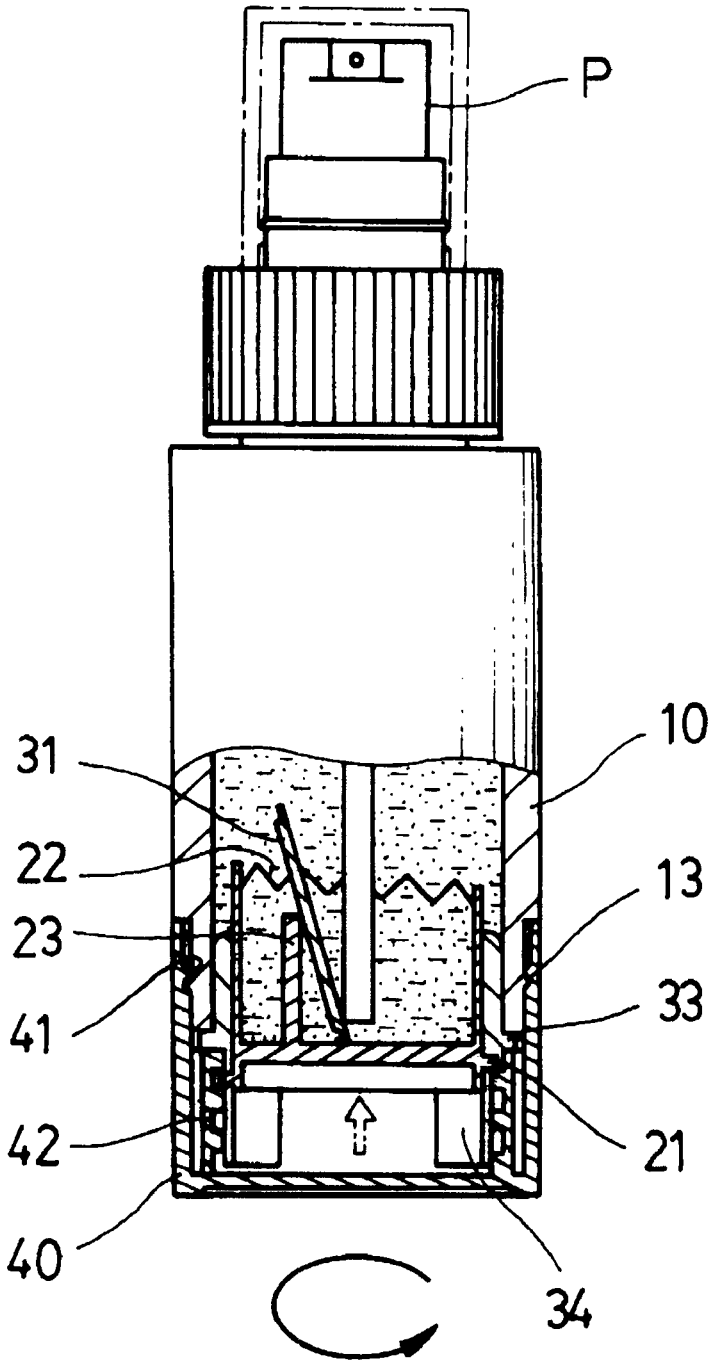
FIG. 4 is a sectional view of the assembled container, in which two substances of FIG. 3 are mixed together.

FIG. 4 shows the container of this invention, when mixing two substances through the above process. The powder storing cup 20 has the serrated blade 22 to smoothly remove the cover plate 31 from the cover unit 30, and also has the support column 23 to prevent the cover plate 31 removed from the cover unit 30 from covering the powder storing cup 20.

As described above, the present invention provides a container, which has a powder storing cup designed in such a way as to remove a cover plate from a cover unit while moving up and be positioned in a liquid storing chamber. Thus, when using the container of this invention, powder is naturally dispersed in liquid and mixed therewith, thus achieving an excellent mixing result, in comparison with the conventional container which is pushed to pressurize powder. Meanwhile, in the container of this invention, the movement of the powder storing cup is carried out by the rotation of a rotor cap rotatably connected to the liquid storing chamber. Therefore, the container of this invention is more advantageous in comparison with the conventional container which needs a strong pressing force for mixing the substances together.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A container capable of separately storing two substances as well as mixing them together, comprising:

a cylindrical liquid storing chamber provided at an upper end thereof with an outlet port and also provided at a lower end thereof with a lower opening, with a locking ring formed around an outer surface of a sidewall defining said opening;

a movable powder storing cup provided at a lower position on an outer surface thereof with at least one projection;

a cover unit consisting of:

a cover plate provided on a top portion of the cover unit and separating the storing chamber from the storing cup;

an annular sidewall having an outer diameter equal to an inner diameter of the liquid storing chamber to be fitted into the lower opening of the storing chamber; and a leg downwardly extending from a lower end of the annular sidewall and provided with a slit engaging with the projection of the storing cup; and a rotary cap consisting of:

an annular groove formed at an upper position on an inner surface of the rotary cap and engaging with the locking ring of the storing chamber; and a spiral groove formed at a lower position on the inner surface of the rotary cap and engaging with the projection of the storing cup, said projection inserted into the slit of the cover unit, wherein the powder storing cup fitted in the cover unit moves upwardly while the cover plate is removed from the cover unit by a rotation of the rotary cap, such that the liquid contained in the liquid storing chamber is mixed with the powder contained in the powder storing cup.

2. The container according to claim 1, wherein said powder storing cup is provided along an upper end thereof with a serrated blade for smoothly removing said cover plate from the cover unit.

* * * * *